United States Patent [19]

Sedala

[11] Patent Number: 4,807,310

[45] Date of Patent: Feb. 28, 1989

[54] PORTABLE SHOWER STALL

[76] Inventor: John R. Sedala, 430 E. Frost Pl., Lake Forest, Ill. 60045

[21] Appl. No.: 37,021

[22] Filed: Apr. 10, 1987

[51] Int. Cl.[4] ..... A47K 3/23

[52] U.S. Cl. ..... 4/599; 4/612

[58] Field of Search ..... 4/596–605, 4/607, 608, 611–617; 52/264, 277, 282, 165, 473; 135/114, 116, 118

[56] References Cited

U.S. PATENT DOCUMENTS

| | | | |
|---|---|---|---|
| 396,624 | 1/1889 | Thomas | 52/165 |
| 1,288,518 | 12/1918 | Collier | 160/183 |
| 1,341,485 | 5/1920 | Stimpson | 4/602 |
| 1,757,664 | 5/1930 | Gohmann | 52/282 |
| 1,917,365 | 7/1933 | Goertz et al. | 52/282 |
| 2,282,362 | 5/1942 | Johnson | 52/264 X |
| 2,540,091 | 2/1951 | Brackney | 52/473 X |
| 2,544,092 | 3/1951 | Karlson | 4/602 |
| 2,975,227 | 3/1961 | Wiater et al. | 52/473 X |
| 3,657,746 | 4/1972 | Downey | 4/599 |
| 4,102,353 | 7/1978 | Pugliese | 135/118 |
| 4,446,585 | 5/1984 | Harding et al. | 52/282 X |

FOREIGN PATENT DOCUMENTS

| | | | |
|---|---|---|---|
| 569774 | 4/1924 | France | 4/596 |
| 739420 | 7/1932 | France | 4/596 |
| 976332 | 12/1948 | France | 4/600 |
| 355758 | 2/1930 | United Kingdom | 4/596 |

*Primary Examiner*—Charles E. Phillips

*Attorney, Agent, or Firm*—Wood, Dalton, Phillips Mason & Rowe

[57] ABSTRACT

A portable shower stall including a plurality of corner posts and upright wall elements removably secured thereto. The shower stall includes a base wall spaced above the subjacent terrain by a plurality of supports. The corner posts extend through a number of the supports and include sharp tipped lower ends adapted to be forced into the subjacent ground for stabilizing the erected shower stall. The sidewalls and door of the shower stall include distributed openings which, in the illustrated embodiment, are in the form of louvers. A top wall may be provided overlying the shower space. Each of the top wall and base wall may be provided with air flow openings, the air flow openings of the base wall further permitting discharge of the shower water downwardly through the subjacent space to the subjacent ground.

26 Claims, 1 Drawing Sheet

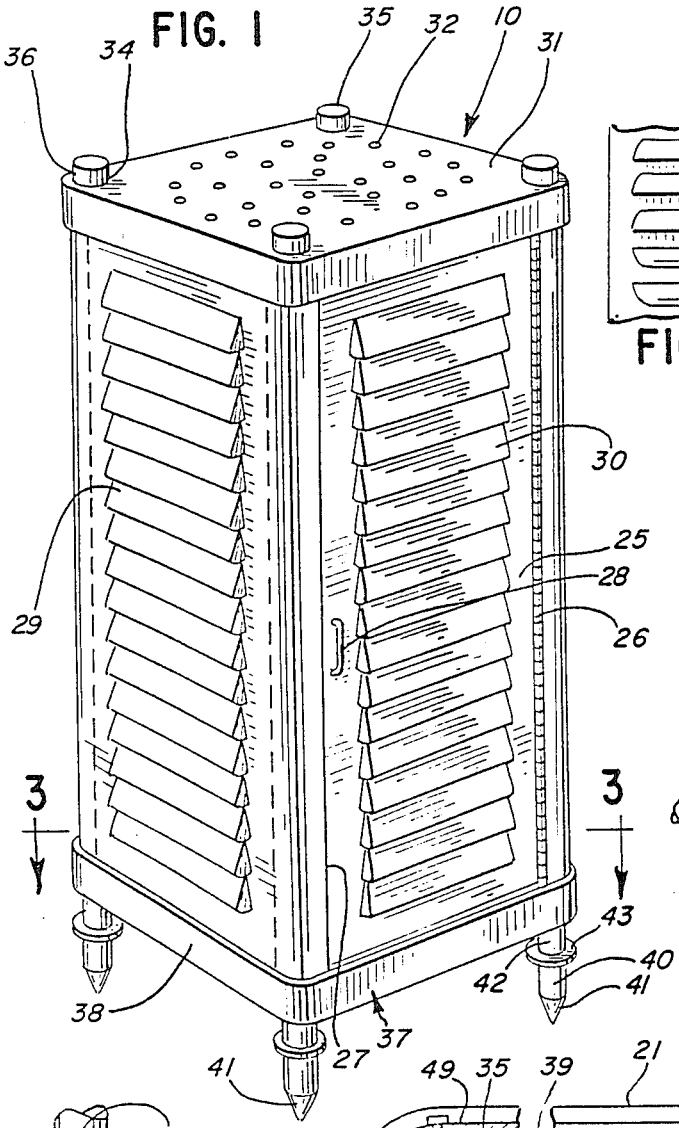
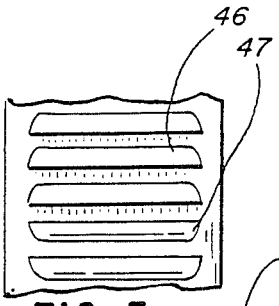
FIG. 5
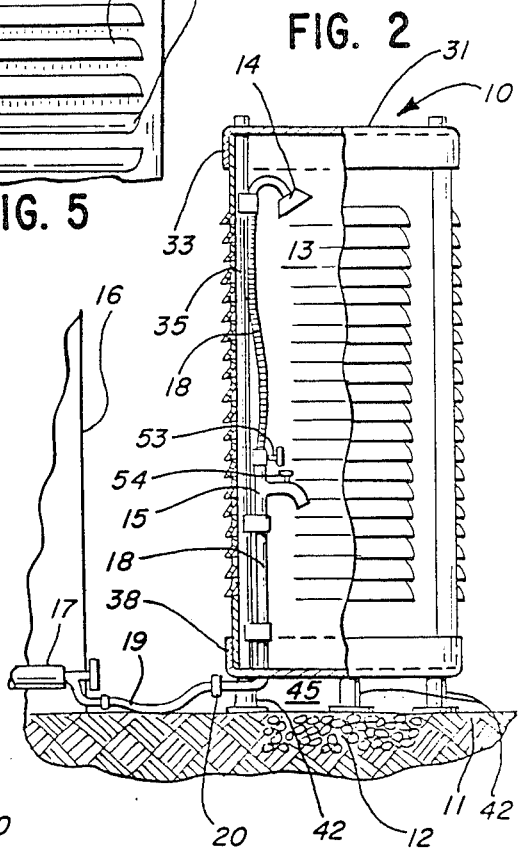
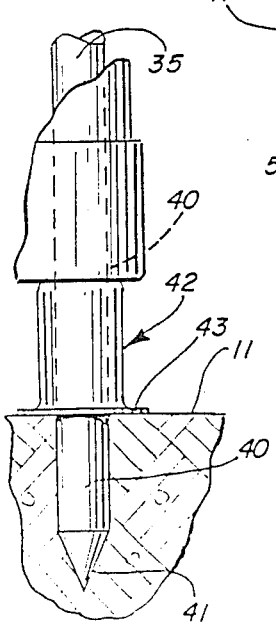
FIG. 4
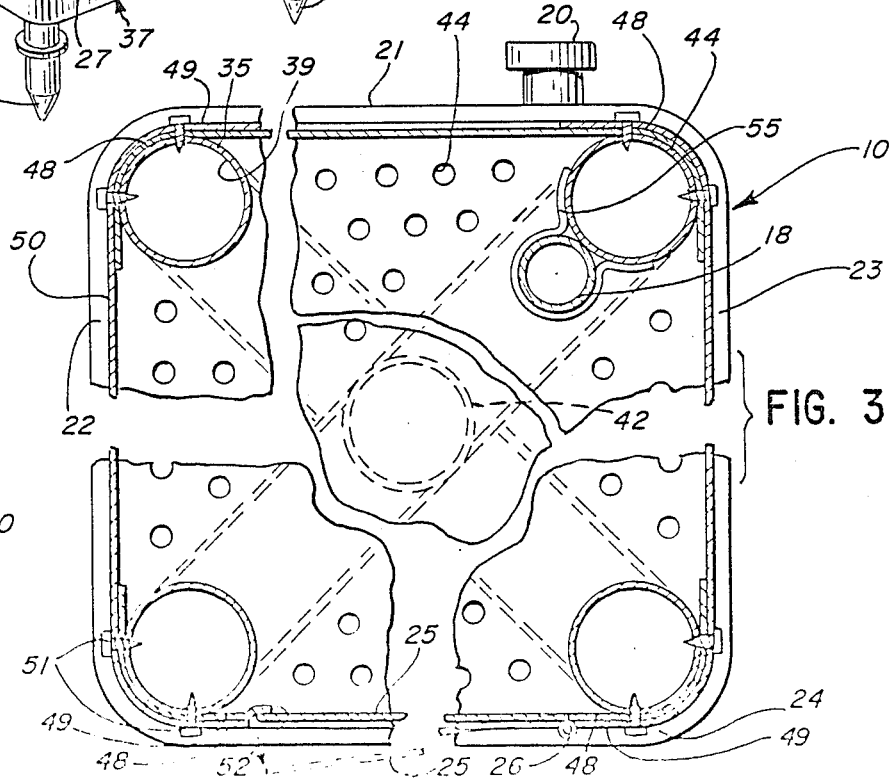
FIG. 3

PORTABLE SHOWER STALL

TECHNICAL FIELD

This invention relates to shower stalls and, in particular, to outdoor shower stalls.

BACKGROUND ART

A number of devices have been developed for permitting persons to shower in outdoor environments. One conventional form of such outdoor shower stall includes a top support with a shower curtain hanging therefrom. Means are provided in association with the enclosure for delivering shower water downwardly thereinto.

It is further conventional to provide shower water to open spaces, such as at sea beaches, to rinse the salt water from the bather.

A common arrangement for such shower stalls is to provide the shower stall within a permanently erected building and to include adjacent dressing room facilities.

DISCLOSURE OF INVENTION

The present invention comprehends the provision of a portable shower stall which may be readily erected for outdoor use when desired, and which may be readily disassembled for storage when desired.

The invention comprehends providing the shower stall with a plurality of distributed openings in different wall portions thereof.

At least a portion of the openings are provided for permitting air flow through the shower stall space. In one embodiment, the shower stall includes a top wall having distributed openings therein for passing air upwardly from the shower stall space.

The invention further comprehends the provision of a base wall of the shower stall having distributed openings therein for permitting upward flow of air into the shower space from subjacent the shower stall and permitting the discharge of shower water downwardly therethrough into the subjacent ground.

The shower stall of the present invention includes a wall portion defining an access opening which is selectively closed by a door.

The door may comprise a wall element similar to the midportion of the sidewalls of the shower stall and may be provided with distributed openings therethrough for passing air inwardly into the shower stall when in use.

The upright wall means of the shower stall includes sidewalls and a plurality of corner posts to which the sidewalls are removably secured in the erected arrangement.

The sidewalls, in the illustrated embodiment, are provided with turned edge portions which are overlapped at the corner posts and secured thereto by suitable removable securing means.

In the illustrated embodiment, the corner posts are right circularly cylindrical and the turned edges of the sidewalls are segmentally cylindrical complementary to the corner post configuration.

Support means are provided for supporting the base wall in an elevated disposition to define an air entrance and water discharge space below the wall means when the support means are placed on the subjacent ground.

The corner posts are arranged to extend through the support means and, in the illustrated embodiment, include lower pointed portions received in the ground for stabilizing the erected portable shower stall.

The invention comprehends the provision of delivery means for providing shower water delivery at an upper portion of the shower space and, in the illustrated embodiment, the delivery means includes means for mixing hot and cold water remotely from the shower stall to provide desired warm water to the water delivery means.

The distributed openings in the sidewalls of the shower stall, in the illustrated embodiment, comprise louver openings.

In one form, the louvers of the sidewalls open downwardly and, in a modified form, a portion of the louvers open downwardly and another portion of the louvers open upwardly.

The shower stall may be formed of molded synthetic resin or other economical material as desired.

The shower stall may be provided with foot-rinsing means subjacent the shower water delivery means.

The portable shower stall structure of the present invention is extremely simple and economical of construction while yet providing the highly desirable advantages discussed above.

BRIEF DESCRIPTION OF THE DRAWINGS

Other features and advantages of the invention will be apparent from the following description taken in connection with the accompanying drawing wherein:

FIG. 1 is a perspective view of a portable shower stall embodying the invention;

FIG. 2 is a side elevation thereof shown partially in section in an installed arrangement;

FIG. 3 is a fragmentary enlarged horizontal section taken substantially along the line 3—3 of FIG. 1;

FIG. 4 is a fragmentary enlarged elevation of the stall support means; and

FIG. 5 is a fragmentary elevation of a modified form of sidewall for use in the portable shower stall.

BEST MODE FOR CARRYING OUT THE INVENTION

In the exemplary embodiment of the invention as disclosed in the drawing, a portable shower stall generally designated 10 is shown to comprise a shower stall adapted to be erected in an outdoor environment on a subjacent ground surface 11. The ground may be provided with a drainage portion 12, illustratively comprising a layer of gravel.

In the illustrated embodiment, the shower stall defines a parallelepiped shower space 13. A shower head 14 is provided in an upper portion of the shower space for delivering shower water onto a person showering in the space.

A foot-rinsing faucet 15 may be provided in a lower portion of the shower space for permitting the user to rinse his feet therein when desired.

The shower stall 10 is adapted for installation in an outdoor environment, such as illustrated in FIG. 2. The stall may be disposed adjacent a building 16 wherein conventional hot and cold water supply means are provided. In the illustrated embodiment, the water is mixed in a conventional mixer 17 to provide warm water to the shower head 14 and faucet 15 through suitable ducts 18 and 19. A connection 20 may be provided for connecting the duct 19 to the internal ducts 18 of the shower stall.

The shower stall space is defined by a plurality of upright wall means, including a rear wall 21, a left sidewall 22, a right sidewall 23, and front wall means 24. A closure door 25 is swingably mounted in the front wall 24 by a hinge 26 providing controlled access to the shower space through an access opening 27 in the front of the shower stall. A suitable handle 28 may be provided on the door for controlled movement thereof.

The invention comprehends that the upright wall means be provided with distributed air flow openings and, in the illustrated embodiment, the air flow openings comprise a plurality of louvers 29. Similar louvers 30 are provided in the door 25. The louvers open downwardly so as to direct air flow into the shower space 13 upwardly to exhaust through the top of the shower space.

In the illustrated embodiment, the top of the shower stall is provided with a top wall 31 having distributed openings 32 therein for passing air upwardly from the shower space. The top wall is provided with a depending flange 33 which peripherally embraces the upper edge of the sidewalls and front wall.

The top wall is further provided with a plurality of corner openings 34. The upright wall means of the shower stall includes four corner posts 35 having upper ends 36 projecting through the openings 34, as seen in FIG. 1. In the illustrated embodiment, the corner posts are right circularly cylindrical, and openings 34 are complementarily circular.

The shower stall further includes a base wall 37 which is generally reversely similar to top wall 31 and which includes an upstanding peripheral flange 38 embracing the lower edges of the upright wall means. The base wall is provided with a plurality of through openings 39 through which the lower ends 40 of corner posts 35 extend. The lower tip 41 of each corner post is pointed and is adapted to be driven into the ground surface 11, as illustrated in FIG. 2, so as to stabilize the erected portable shower stall on the ground surface 11.

Base wall 37 is spaced above the ground surface 11 by support means generally designated 42 comprising tubular spacers having a lower outturned annular flange 43 adapted to rest on the ground surface over a substantial area. In the illustrated embodiment, the support elements are formed integrally with the base wall to depend therefrom from the four corners and from a midportion thereof. Alternatively, the support elements may be provided as separate elements through which the lower ends of the corner posts extend and with the central element 42 merely set in place between the base wall and subjacent ground at a midportion of the base wall.

In the illustrated embodiment, the louvers 29 open downwardly so as to direct air upwardly through the shower space 13. The heat of the shower water causes a convective upward flow of the air through the upper openings 32 in top wall 31 so as to provide an invigorating and stimulating subjection of the showerer to the air flow. Base wall 37 is provided with distributed openings 44 augmenting this air flow by delivering air from the space 45 subjacent the base wall above ground surface 11. Openings 44 further serve to discharge the shower water downwardly into the subjacent drainage gravel 12.

In a modified form, as shown in FIG. 5, the louvers may include a first portion 46 of downwardly opening louvers and a second portion 47 of upwardly opening louvers for providing a more turbulent air flow through the shower space 13, as desired.

Each of sidewalls 21, 22 and 23 is defined by turned vertical edge portions 48 and 49, and a flat midportion 50 provided with the louvers 29. The edge portions are overlapped at the corner posts and are secured to the corner posts by suitable removable securing means, such as screws 51.

Front wall means 24 includes similarly turned edge portions 48 and 49 which are overlapped with the turned edge portions of the sidewalls 22 and 23 at the front corner posts, as best seen in FIG. 3. Thus, the turned edge portions of the front wall define the frame foredoor 25, with the right turned edge portion carrying the hinge 26, as seen in FIG. 3.

In the manufacture of the portable shower stall, the front wall may comprise a wall similar to each of the other sidewalls, with the door being cut out therefrom, thereby facilitating manufacture and minimizing cost of the shower stall structure.

To maintain door 25 in the closed disposition, a magnetic closure strip means 52 of conventional construction may be provided to the confronting door edge and front wall edge, as illustrated in FIG. 3.

The water delivery means may include suitable valves 53 and 54 for controlling flow of the shower water and foot-rinsing water, as desired. The water conduits may be secured to one of the corner posts by a suitable bracket 55, as shown in FIG. 3.

In addition to providing for desirable air flow through the shower space, the louvers have been found to provide improved stability in the erection of the shower stall in outdoor environments against wind forces. The portable shower stall unit may be readily erected and disassembled when desired, providing improved facility in the location and use thereof.

The corner posts may be formed of tubular synthetic resin, such as polyvinylchloride pipe, and in the illustrated embodiment, comprise 2"-diameter pipes. The support elements 42 may comprise tubular plastic elements having a height of approximately 6". The height and transverse dimensions of the shower stall may be made as desired, as will be obvious to those skilled in the art.

The foregoing disclosure of specific embodiments is illustrative of the broad inventive concepts comprehended by the invention.

I claim:

1. A portable shower stall comprising:

upright wall means including sidewall panels and corner posts for forming an enclosure defining a shower space, said wall means being provided with inclined air deflecting means distributed along substantially the entire height of the sidewall panels for directing air flow from circumjacent said enclosure upwardly into said shower space, said wall means further defining an access opening for providing access to the shower space;

a door swingably mounted to said wall means for selectively closing said access opening;

a base wall having distributed openings therethrough for passage of air into and water out of the shower space, and through openings therein, said base wall being disposed at a bottom portion of said shower space for supporting a person therein;

support means comprising tubular spacers having a lower support portion defining a downwardly facing support surface arranged to be supported on a subjacent ground surface, said corner posts passing through said through openings and said spacers and having a tapered end adapted to be driven into the subjacent ground surface, said base wall resting on an upper portion of said spacers for supporting said enclosure in an elevated disposition above the ground surface to define a laterally open air space below said base wall; and delivery means for providing a shower water delivery at an upper portion of said shower space, said enclosure further including a top wall closing the top of said shower space and having means for permitting limited upward convection from said shower space of air guided upwardly into said shower space by said air deflecting means.

2. The portable shower stall of claim 1 wherein said air deflecting means defines a plurality of louvers.

3. The portable shower stall of claim 1 wherein said wall means defines a plurality of louvers defining said openings, at least a portion of said louvers being inclined downwardly outwardly from said space.

4. The portable shower stall of claim 1 wherein said wall means defines a plurality of louvers defining said openings, at least a portion of said louvers being inclined upwardly outwardly from said space.

5. The portable shower stall of claim 1 further including means remote from said shower space for mixing heated and cold water to provide shower water at a preselected temperature to said delivery means.

6. The portable shower stall of claim 1 further including threaded means for securing said panels to said corner posts.

7. The portable shower stall of claim 1 wherein said support means comprises supports formed integrally with said base wall.

8. The portable shower stall of claim 1 wherein said support means comprises supports mounted to said base and said corner posts are removably secured to said supports.

9. The portable shower stall of claim 1 wherein said support means comprises supports mounted to said base and said corner posts are removably secured to said supports and have pointed lower ends adapted to be removably pressed into the subjacent ground surface below said base.

10. The portable shower stall of claim 1 wherein said door is provided with air deflecting means distributed along substantially the entire height of the sidewall panels for directing air flow from adjacent said enclosure upwardly into said shower space.

11. The portable shower stall of claim 10 wherein said air deflecting means comprises a plurality of louvers.

12. The portable shower stall of claim 1 wherein said support means comprises a plurality of tubular elements depending from said base and having an annular outturned flange defining a pad for facially resting on the subjacent ground surface to support the shower stall thereon.

13. The portable shower stall of claim 1 wherein said means for permitting upward convection of the air comprises air flow openings distributed in said top wall.

14. The portable shower stall of claim 1 wherein said top wall includes corner portions each having an opening, said uprights defining upper ends extending one each through said top wall corner openings.

15. The portable shower stall of claim 1 wherein said top wall means comprises a plurality of corner uprights and a plurality of panels removably secured to said uprights, said top wall is removably supported by said panels sidewall.

16. The portable shower stall of claim 1 wherein each sidewall panel includes a flat midportion provided with said air deflecting means and having opposite turned edges, said turned edges being complementary to said corner posts and being juxtaposed in overlapping relationship therewith, and means are provided for removably securing said overlapping turned edges to said posts.

17. The portable shower stall of claim 16 wherein said corner posts are right circularly cylindrical and said sidewall turned edges comprise segmentally cylindrical edges complementary to said corner posts.

18. The portable shower stall of claim 16 wherein one of said wall means comprises a front wall portion defining turned edges, and said door is swingably mounted to one of said front wall portion turned edges.

19. The portable shower stall of claim 16 wherein said door comprises a wall element comprising the midportion of a panel corresponding to said sidewalls.

20. The portable shower stall of claim 1 wherein said support means comprise tubular elements.

21. The portable shower stall of claim 1 further including support means disposed subjacent said base wall and spaced inwardly of said corner posts.

22. The portable shower stall of claim 1 wherein said top wall is concave opening downwardly.

23. The portable shower stall of claim 1 wherein said top wall includes a midportion and a peripheral portion extending below said midportion.

24. The portable shower stall of claim 1 wherein said top wall includes a depending peripheral flange.

25. The portable shower stall of claim 1 wherein said corner posts define upper ends and said top wall includes corner portions and means at the corner portions for receiving said upper ends of the corner posts.

26. The portable shower stall of claim 1 wherein said corner posts comprise pipes.

* * * * *